United States Patent [19]

McGill

[11] 4,346,660

[45] Aug. 31, 1982

[54] SELF-SUPPORTING INCINERATOR AND EXPANDABLE SHIELD THEREFOR

[75] Inventor: Eugene C. McGill, Skiatook, Okla.

[73] Assignee: McGill Incorporated, Tulsa, Okla.

[21] Appl. No.: 195,070

[22] Filed: Oct. 8, 1980

[51] Int. Cl.[3] ..... B09B 3/00

[52] U.S. Cl. ..... 110/235; 98/60; 138/114; 431/202

[58] Field of Search ..... 110/235, 346, 184; 98/58, 60; 431/202; 138/113, 114; 422/182; 126/307 R

[56] References Cited

U.S. PATENT DOCUMENTS

| | | | |
|---|---|---|---|
| 1,622,431 | 3/1927 | Fiegenbaum | 110/235 |
| 3,022,753 | 2/1962 | Montgomery | 110/235 X |
| 3,368,506 | 2/1968 | Lawrence | 110/184 |
| 3,537,411 | 11/1970 | Roy | 98/60 X |
| 3,822,636 | 7/1974 | Chadwick | 110/184 X |
| 3,887,324 | 6/1975 | Reed et al. | 431/202 |
| 4,064,793 | 12/1977 | Bennett | 110/184 X |
| 4,140,471 | 2/1979 | Straitz et al. | 431/202 X |

*Primary Examiner*—Edward G. Favors
*Attorney, Agent, or Firm*—Bill D. McCarthy

[57] ABSTRACT

An improved, self-supporting incinerator having a combustion chamber for burning sulfur containing compounds therein and adapted to eliminate plume formation resulting from the combustion of such compounds. The incinerator includes a vertically disposed housing and a vertically disposed elongated stack concentrically disposed in the housing such that a portion of the stack extends a distance from the housing. The portion of the stack extending above the housing is further provided with an expandable shield formed of a plurality of members, the expandable shield adapted to expand independently to the expansion of the stack.

20 Claims, 7 Drawing Figures

SELF-SUPPORTING INCINERATOR AND EXPANDABLE SHIELD THEREFOR

BACKGROUND OF THE INVENTION

1. Field of the Invention

This invention relates generally to incinerators, and more particularly, but not by way of limitation, to an improved, self-supporting incinerator having a combustion chamber and a stack.

In one aspect, the present invention relates to an improved shield assembly for use in combination with a stack wherein the shield assembly is adapted to expand independently of the expansion of the stack.

2. Brief Description of the Prior Art

In certain refinery operations hydrogen sulfide and other sulfur bearing compounds are removed from sour gas refinery streams in order to provide sweet gas streams. Further, other refinery operations produce hydrogen sulfide and other sulfur bearing compounds which must be processed through sulfur recovery systems; even so, the effluent or tail gas from such sulfur recovery systems contain residual sulfide products. The sulfide so removed or produced must be disposed of in an economical manner. Thus, the hydrogen sulfide is often burned in a gas incinerator and the combustion products vented to the atmosphere via a stack.

The recovery or removal of sulfur bearing compounds such as hydrogen sulfide from refinery operations often results in the formation of a plume external to the stack of the incinerator or sulfur recovery system through which the effluent or tail gases from such refinery operations are vented to the atmosphere. The plume formation is an aerosol effect resulting from the reaction of the sulfur containing effluent or tail gas and moisture in the atmosphere as the effluent or tail gas cool after leaving the stack of the incinerator or sulfur recovery system. The plume, is highly corrosive, may be irritating to a person's eyes, nose and throat, may cause crop damage, and is generally a violation of certain governmental regulations.

Incinerators for the burning of a tail gas, such as hydrogen sulfide, or the burning of other sulfur bearing effluents, have heretofore been known. Generally the prior art devices include a refractory lined combustion chamber and a tall stack. The combustion in such prior art devices generally occurs in the housing portion of the assembly and is vented to the atmosphere through the stack. Of prime concern in the use of such incinerators is the adequate dispersal of sulfur dioxide into the atmosphere to prevent the formation of an undesirable ground concentration of pollutants. The main factors which affect the ground concentration of the pollutants are the rate of release of the pollutant from the stack, the temperature of the stack gases, and atmospheric conditions. In many instances one must employ a very tall stack to ensure adequate dispersal of sulfur dioxide into the atmosphere.

However, problems have been encountered in the prior art devices when burning hydrogen sulfide in that if the combustion products remain in the incinerator and stack for a period of time greater than about 20 seconds the sulfur dioxide produced by the burning of the hydrogen sulfide reacts with oxygen to form sulfur trioxide which can subsequently react with water, either in the apparatus or the atmosphere, to produce sulfuric acid. Sulfuric acid fumes, when vented from the stack, combine with water vapor and are cooled. When the dewpoint temperature is reached, a dense opaque plume consisting of sulfuric acid aerosol mist is formed. This resulting plume is highly corrosive to practically everything which it contacts.

In addition, many of the prior art incinerators are provided with an outer shell surrounding the stack, the outer shell serving as a rain and heat shield to prevent corrosion of the stack, as well as controlling deflection due to temperature differences. However, problems have been encountered in the prior art devices in that the prior art shields are not capable of expanding when the stack of the incinerator is thermally expanded. Thus, the shields are often damaged as the result of the thermal expansion of the stack, or the stack itself is damaged due to resistance to thermal expansion of the stack by the outer shell serving as the rain or heat shield. Also, the shields of the prior art devices have been very expensive to install because the shields are easily damaged during erection of the stack if the shields are connected to the stack at ground level. Thus, to prevent damage to the shields the shields have been connected to the erected stack which may extend several hundred feet above the ground, and complex banding and clip assemblies have been devised for the shield installation, making it difficult to install the shield at elevated heights.

Thus, a need has long existed for an improved incinerator wherein the residence time of the combustible materials in the incinerator can be more effectively controlled to insure that when burning certain gases in the incinerator, such as hydrogen sulfide, the residence time of the gas in the incinerator and stack is sufficiently short to prevent the conversion of the sulfur dioxide into the undesired sulfur trioxide component which can thereafter react with the water in the apparatus or the atmosphere to produce a heavy grey sulfuric acid plume. It is also highly desirable that the apparatus be equipped with a rain and heat shield which will not be damaged, or cause damage to the stack of the incinerator, when the stack is expanded as a result of the heat gradient placed on it as a result of the combustion of the gases in the incinerator. Further, it would be most advantageous if the rain and heat shields could be connected to the stack with simple tools.

SUMMARY OF THE INVENTION

According to the present invention an improved, self-supporting incinerator is provided which substantially eliminates plume formation resulting from the combustion of sulfur bearing compounds, such as hydrogen sulfide, in the incinerator. Broadly, the improved, self-supporting incinerator comprises a vertically disposed housing having a vertically disposed elongated stack concentrically disposed therein such that the lower end portion of the stack defines the combustion chamber of the incinerator and the upper end portion of the stack extends a distance above the housing. More specifically, the portion of the vertically disposed elongated stack of the incinerator which is disposed above the housing is provided with an expandable shield assembly which is adapted to expand independently to the stack of the incinerator as the stack expands due to the combustion occurring within the incinerator.

An object of the present invention is to provide an improved, self-supporting incinerator having a combustion chamber for burning gases therein which is adapted to eliminate plume formation resulting from the combustion of the gases.

Another object of the invention is to provide an improved, self-supporting incinerator having an expandable shield for a vertically disposed, elongated stack of the incinerator which is capable of expanding independently to the stack due to combustion in the incinerator.

Another object of the present invention is to provide an improved expandable shield for an incinerator which can be readily adapted and employed as a rain and heat shield for a stack of an incinerator to prevent corrosion of the stack while controlling deflections of same due to temperature differences.

Other objects, advantages and features of the present invention will become apparent to those skilled in the art of incinerators from the reading of the following detailed description when read in conjunction with the accompanying drawings and the appended claims.

DETAILED DESCRIPTION OF THE INVENTION

Figure 1:
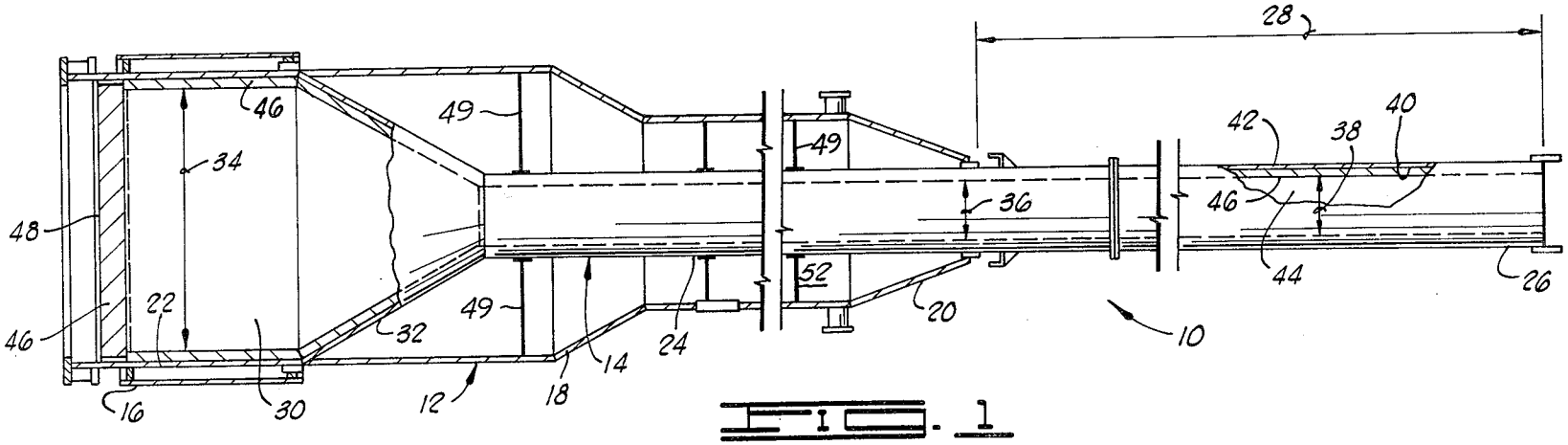
FIG. 1 is a sectional view of an improved, self-supporting gas incinerator constructed in accordance with the present invention with portions of the apparatus shown schematically to more clearly illustrate the invention.
Figure 2:
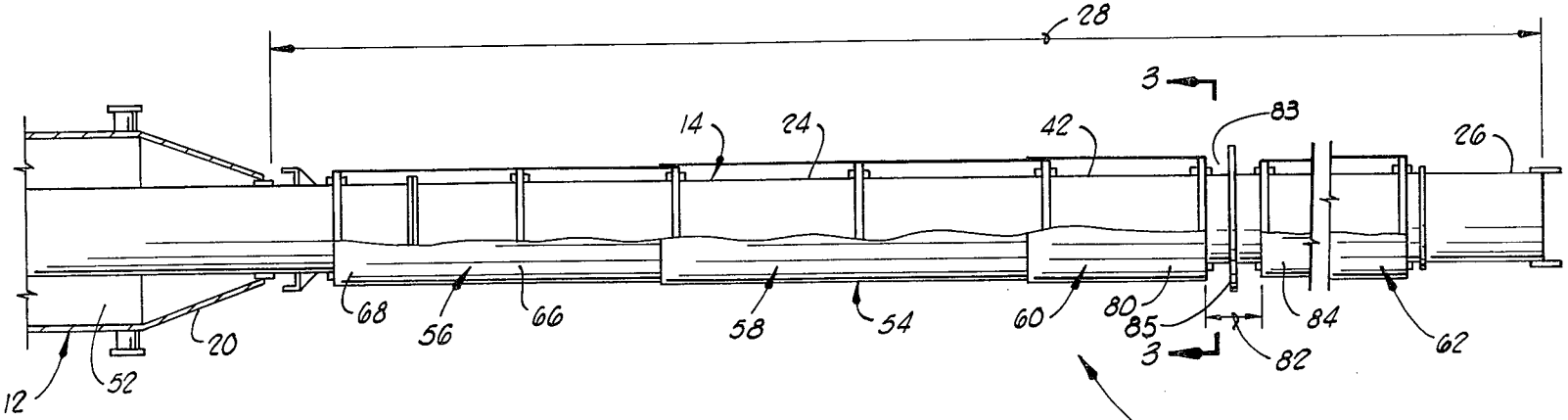
FIG. 2 is a sectional view of an upper end portion of a housing and an expandable shield disposed about an upper end portion of a vertically disposed elongated tubular member of the gas incinerator constructed in accordance with the present invention with portions of the apparatus shown schematically to more clearly illustrate the invention.
Figure 3:
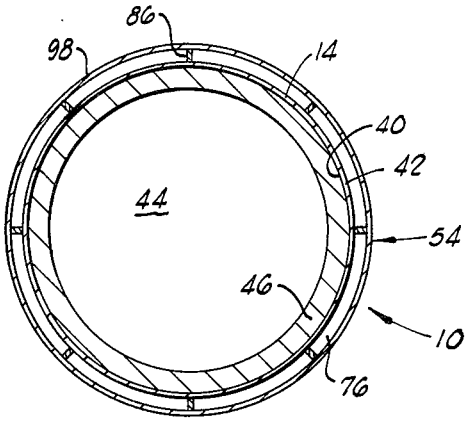
FIG. 3 is a sectional view taken along the line 3—3 of FIG. 2.
Figure 4:
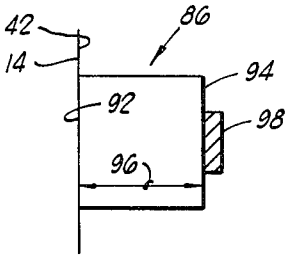
FIG. 4 is a side view of a spacer member for securing an upper portion of a shield member of the shield assembly to the elongated tubular member of the incinerator in accordance with the present invention.
Figure 5:
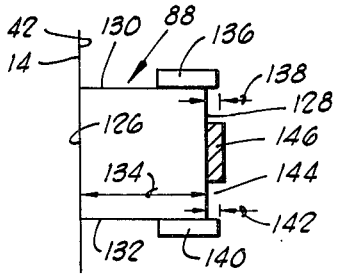
FIG. 5 is a side view of a spacer member for slidably supporting a medial portion of a shield member of the shield assembly.
Figure 6:
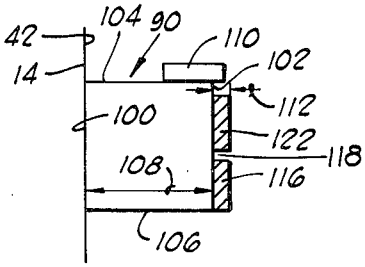
FIG. 6 is a side view of a spacer member for slidably connecting a lower end portion of a shield member of the shield assembly to the elongated tubular member of the incinerator in accordance with the present invention.
Figure 7:
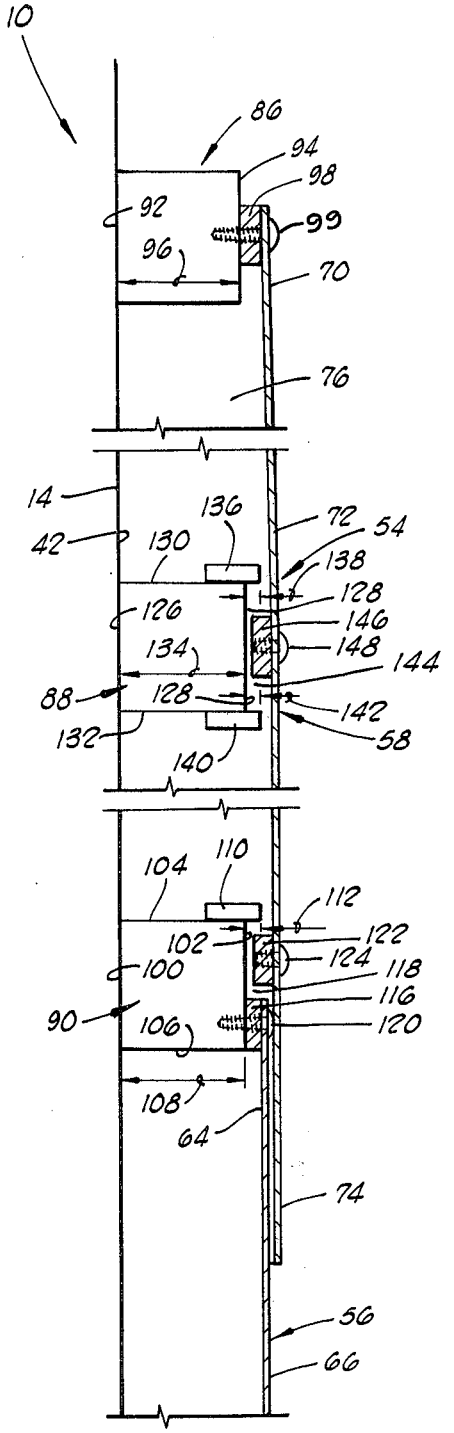
FIG. 7 is a sectional view of a portion of the gas incinerator depicting two shield members of the shield assembly and the connection of same to the elongated tubular member via the spacer members depicted in FIGS. 4, 5 and 6.

Referring now to the drawings, and particularly to FIGS. 1 and 2, shown therein and represented by the reference numeral 10 is an example of an improved, self-supporting incinerator constructed in accordance with the present invention for burning a tail gas. However, it is to be understood that the incinerator 10 illustrated in the drawing is merely an example of an apparatus for burning sulfur bearing compounds and the subject invention is not limited to the apparatus 10 as illustrated. The self-supporting incinerator 10 comprises a housing 12 and an elongated stack 14 concentrically disposed in the housing 12 substantially as shown. The housing 12, a vertically disposed housing, is provided with a lower end portion 16, a medial portion 18, and an opposed upper end portion 20. The elongated stack 14, also a vertically disposed member, is provided with a lower end portion 22, a medial portion 24, and an upper end portion 26. The lower end portion 22 of the stack 14 is disposed substantially adjacent the lower end portion 16 of the housing 12; and the upper end portion 20 of the housing 12 is connected to the medial portion 24 of the stack 14 such that the upper end portion 26 of the stack 14 extends a distance 28 from the upper end portion 20 of the housing 12. It should be noted that lower end portion 22 of the stack 14 is illustrated as being integral with a combustion chamber 30 formed therein. However, the combustion chamber 30 can be formed separately of the lower end portion 22 using techniques well known to those skilled in the art of incinerators.

Referring more specifically to FIG. 1, the relationship between the stack 14 and the housing 12 is illustrated. As previously stated, the lower end portion 22 of the stack 14 defines the combustion chamber 30 of the self-supporting gas incinerator 10. The combustion chamber 30 of the self-supporting gas incinerator 10 is provided with a gas inlet (not shown) and a series of burners (also not shown) so that gas directed into the combustion chamber 30 can be ignited by the burners to produce the desired combustion products for venting to the atmosphere. The use, construction, and interconnection of the burners and the gas inlet in the combustion chamber 30 are well known in the art of gas incinerators. Thus, no further details or comments as to such components are believed necessary.

As previously stated, the combustion chamber 30 of the self-supporting gas incinerator 10 is formed in the lower end portion 22 of the stack 14. The combustion chamber 30 can be formed by providing a flared portion 32 in the portion of the medial portion 24 of the stack 14 adjacent the lower end portion 22 of the stack 14. Thus, the lower end portion 22 of the stack 14 forming the combustion chamber 30 is provided with a diameter 34 which is greater in size than a diameter 36 of the medial portion 24 and a diameter 38 of the upper end portion 26 of the stack 14.

The stack 14 is provided with an interior surface 40 and an exterior surface 42. The interior surface 40 of the stack 14, which defines the combustion chamber 30 in the lower end portion 22, and a fluid flow passageway 44 in the medial portion 24 and the upper end portion 26 thereof, is provided with a refractory liner 46. The refractory liner 46 is secured to the stack 14 via the interior surface 40 thereof such that the refractory liner 46 extends the length of the stack 14. Thus, the refractory liner 46 lines the combustion chamber 30 formed in the lower end portion 22 of the stack 14, and the fluid passageway 44 formed in the medial portion and upper end portion 24, 26, of the stack 14.

A plate 48 is positioned across the lower end portion 22 of the stack 14, the plate 48 defining the bottom portion of the combustion chamber 30. The refractory liner 46 is positioned on plate 48 such that the combustion chamber 30 formed in the lower end portion 22 of the stack 14 is completely lined with the refractory liner 46.

As illustrated in FIG. 1, the lower end portion 16 of the housing 12 is disposed substantially adjacent the lower end portion 22 of the stack 14; and the upper end portion 20 of the housing 12 is connected to the medial portion 24 of the stack 14 via a plurality of laterally disposed support members 49 such that a space 52 is formed between the medial and upper end portions 18, 20 of the housing 12 and the medial portion 24 of the stack 14 disposed within the medial and upper end portions 18, 20 of the housing 12. Thus, the housing 12 serves as an outer shield for the portion of the stack 14 disposed therein, the shield preventing corrosion from environmental effects of the portion of the stack 14 positioned within the housing 12. The laterally disposed support members 49, which connect the housing 12 to the stack 14, also support the housing 12 during shipment of the housing 12 since the shipment of the incinerator 10 is generally accomplished in sections.

Referring now to FIGS. 2–7, the self-supporting incinerator 10 of the present invention further comprises a shield assembly 54 disposed about the medial and upper end portions 24, 26 of the stack 14 (i.e. the portion of the stack 14 extending upwardly from the upper end portion 20 of the housing 12). The shield assembly 54, an expandable shield assembly, is operably connected to the tubular stack member 14 such that the shield assembly 54 can expand independent of the expansion of the stack 14. Further, the shield assembly 54 functions as a rain and heat shield to prevent corrosion due to environmental effects of the portion of the stack 14 enclosed by the shield assembly 54, as well as controlling deflections therein due to temperature differences.

The shield assembly 54 of the self-supporting incinerator 10 comprises a plurality of shield members, such as shield members 56, 58, 60 and 62 illustrated in FIG. 2. The before mentioned shield members 56, 58, 60 and 62 are mounted on the exterior surface 42 of the medial portion and upper end portion 24, 26 of the stack 14 such that the shield members 56, 58, 60 and 62 can be expanded or retracted within certain limits independently of the expansion or retraction of the stack 14. The unique interconnection of the shield members 56, 58, 60 and 62 to each other and to the stack 14 is more clearly illustrated in FIGS. 4–8.

Referring more specifically to FIGS. 4–8, the shield members 56, 58, are illustrated in a connected position to the stack 14. Shield member 56 of the shield assembly 54 is provided with an upper end portion 64, a medial portion 66, and a lower end portion 68 (see FIG. 2); and the shield member 58 is provided with an upper end portion 70, a medial portion 72, and a lower end portion 74. The shield members 56 and 58 are connected to the exterior surface 42 of the stack 14 such that an annular passageway 76 is formed therebetween. Further, the shield members 56 and 58 are positioned such that the lower end portion 74 of the shield member 58 (which is slidably connected to the stack 14) overlaps the upper end portion 64 of the shield member 56 as shown. The upper end portion 64 of the shield member 56, as well as the upper end portion of each of the other shield members of the shield assembly 54, such as shield member 58, is connected to the stack 14 in a substantial rigid position. The connection of the upper and lower end portions 64, 68 of the shield member 56, and the upper end portion 70 of the shield member 58, will be discussed in more detail hereinafter. However, certain other of the shield members, such as shield members 60 and 62 (see FIG. 2) are secured to the exterior surface 42 of the stack 14 such that an upper end portion 80 of the shield member 60 is positioned a distance 82 from the lower end portion 84 of the adjacently disposed shield member 62 so that a space 83 is formed therebetween. The space 83 formed between the two shield members 60, 62 allows air to enter and exit the annular passageway 76 formed between each of the shield members forming the shield assembly 54.

An air deflector member 85 is secured to the exterior surface 42 of the stack 14 such that the air deflector member 85 is disposed between the upper end portion 80 of the shield member 60 and the lower end portion 84 of the shield member 62. The air deflector member 85 extends from the stack 14 a distance at least substantially equal to, and preferably greater than, the width of the annular passageway 76 formed between the shield member and the stack 14. Thus, the air deflector member 85 deflects the hot air exiting the annular passageway 76 via the upper end portion 80 of the shield member 60 outwardly from the stack 14; and the air deflector member 85 directs cooler ambient air into the annular passageway 76 via the lower end portion 84 of the shield member 62. The air deflector member 85 further serves as a water or rain shield to prevent water from entering the annular passageway 76 via the space 82 formed between the upper end portion 80 of the shield member 60 and the lower end portion 84 of the shield member 82.

As previously stated, the upper end portions of the shield members of the shield assembly 54, such as the upper end portions 64, 70 of the shield members 56, 58, are rigidly connected to the exterior surface 42 of the stack 14; and the lower end portions of the shield members of the shield assembly 54, such as the lower end portion 74 of the shield member 58, are slidably connected to the exterior surface 42 of the stack 14 in such a manner that the shield assembly 54 can expand or retract independently of the expansion of the stack 14 of the self-supporting incinerator 10.

In order to achieve the desired attachment of the shield members of the shield assembly 54, such as shield members 56 and 58, to the exterior surface 42 of the stack 14 and provide the annular passageway 76 therebetween, a plurality of spacer members, such as members 86, 88 and 90, are secured at the desired position to the exterior surface 42 of the stack 14. The upper and lower end portions of the shield members of the shield assembly 54, such as shield members 56 and 58, are connected to the exterior surface 42 of the stack 14 via spacer members 86 and 90 as will now be described in detail.

Spacer member 86, a bar-shaped member, is provided with a first side 92 and an opposed second side 94. A plurality of the spacer members 86 are axially disposed along the perimeter of the stack 14 in a spatial relationship, one with another, and the spacer members 86 are secured to the exterior surface 42 of the stack 14 via the first side 92 thereof such that the opposed second side 94 of each of the spacer members 86 extends a distance 96 from the stack 14. A ring element 98 is positioned around each of the spacer members 86 and the ring element 98 is connected to each of the spacer members 86, via the opposed second side 94 thereof, by any suitable means, such as welding and the like. Thus, the upper end portion 70 of the shield member 58 is connected to the stack 14 via the ring element 98 and the spacer member 86 by any suitable means, such as bolt 99.

The ring element 98 will generally have a circular configuration. However, it should be understood that the ring element 98, as well as the other ring elements which will be described hereinafter, can have any desired geometrical configuration, the particular configuration chosen depending upon the configuration of the exterior surface of the stack 14.

Spacer member 90, a bar-shaped member, is provided with a first side 100, a second side 102, an upper side 104, and an opposed lower side 106. A plurality of the spacer members 90 are axially disposed along the perimeter of the stack 14 in a spatial relationship, one with another, and each of the spacer members 90 are secured to the exterior surface 42 of the stack 14 via the first side 100 thereof such that the second side 102 of each of the spacer members 90 extends a distance 108 from the exterior surface 42 of the stack 14. A flange 110 is supported by and connected to the second spacer members 90 along the upper side 104 of the spacer members 90 such that the flange 110 extends a distance 112 from the opposed second side 102 of each of the spacer members 90.

A ring element 116 is positioned on each of the spacer members 90 such that the ring element 116 is disposed adjacent the opposed second side 102 of the spacer members 90. The ring element 116 is positioned on the spacer members 90 substantially as shown in the drawing such that the flange 110, the ring element 116, and the portion of the opposed second side 102 of the spacer member 90 disposed therebetween form a recessed slot 118. Thus, the flange 110 defines the upper edge portion of the recessed slot 118 and the ring element 116 defines the lower edge portion of the recessed slot 118. The ring element 116 is secured to the opposed second side 102 of the spacer member 90 by any suitable means, such as welding. Further, the upper end portion of the adjacently disposed shield member, such as the upper end portion 64 of the shield member 56, is connected to the ring element 116 and thus to the spacer member 90 by any suitable means, such as bolt 120.

The recessed slot 118 formed by the flange 110, the ring element 116, and the opposed second side 102 of the spacer member 90 is adapted to receive a ring element 122 connected to the lower end portion 74 of the shield member 58 by any suitable means such as bolt 124. The ring element 122 is positionable within the recessed slot 118 formed by the flange 114, the ring element 116, and the opposed second side 102 of the spacer member 90 such that the ring element 122 can be vertically moved within the recessed slot 118. The vertical movement of the ring element 122 in the recessed slot 118 enables the shield member 58, and thus the shield assembly 54, to expand independently to the expansion of the stack 14 because of thermal expansion of the stack 14.

It should be noted that the spacer members 86 and 90 are disposed along the portion of the stack 14 between the upper end portion 20 of the housing 12 and the upper end portion 26 of the stack 14. Further, the spacer members 86 securely connect the upper end portion of each of the shield members of the shield assembly 54 to the stack 14; whereas the spacer members 90 slidably connect the lower end portion of each of the shield members of the shield assembly 54 to the stack 14. The unique interconnection of the shield members of the shield assembly 54 by the spacer members 86, 90 allows the shield assembly 54 to expand as set forth above, and further provides a convenient means for overlapping the lower end portion of the shield members with the upper end portion of the adjacently disposed shield member.

In order to further support the shield members of the shield assembly 54, such as the shield member 58, a plurality of spacer members, such as spacer member 88, are axially disposed along the perimeter of the stack 14 in a spatial relationship one with another and at a position between the upper end portion 70 and the lower end portion 74 of the shield member 58. The spacer member 88, a bar-shaped member, is provided with a first side 126, an opposed second side 128, an upper side 130, and an opposed lower side 132. The spacer member 88 is connected to the exterior surface 42 of the stack 14 via the first side 126 thereof such that the opposed second side 128 of the spacer member 88 extends a distance 134 from the exterior surface 42 of the stack 14. A flange 136 is supportably connected to the spacer member 88 along the upper side 130 thereof such that the flange 136 extends a distance 138 from the opposed second side 128 of the spacer member 88. A flange 140 is connected to the spacer member 88 along the opposed lower side 132 thereof such that the flange 140 extends a distance 142 from the opposed second side 132 of the spacer member 88. Thus, the flange 136, the opposed second side 128 of the spacer member 88, and the flange 140 cooperate to define a recessed slot 144 along the opposed second side 128 of the spacer member 88, the flange 136 defining the upper edge portion of the recessed slot 144 and the flange 140 defining the lower edge portion of the recessed slot 144.

A ring element 146 is connected to the medial portion 72 of the shield member 58 by any suitable means, such as bolt 148. The ring element 146 is positionable within the recessed slot 144 formed on the opposed second side 128 of the spacer member 88, the ring element 146 being slidably movable in the vertical direction in the recessed slot 144 such that the recessed slots 118 and 144 formed in the spacer members 90 and 88, respectively in cooperation with the ring elements 122 and 146, allow the shield assembly 54 to expand independently to the expansion of the stack 14 resulting from the combustion of gases in the combustion chamber 30 formed in the lower end portion 22 of the stack 14.

The self-supporting incinerator 10 as described above permits better design control of the residence time of the gases in the incinerator and thus the prevention of plume formation when the combustion products are vented into the atmosphere. The reason for this is that the self-supporting incinerator 10 is designed with the stack 14 having a substantially constant diameter 34 along its length extending above the combustion chamber. This is made possible by the support that is provided to the stack 14 by the housing 12. That is, prior art stacks of necessity had varying diameter stack portions that made up the total stack, with larger stack portions required at lower elevations and reduced stack portions at higher elevations of the total stack. This arrangement was provided because the lower stack portions served as structural support members, while in the present invention, the stack 14 is supported by the independent housing 12. This permits the diameter of the stack to be constant throughout its length above the combustion chamber, and facilitates designing for a required residence time depending upon the volume of gaseous byproducts generated in the combustion chamber 30. Furthermore, less refactory 46 is required for the stack 14 since the larger support stack portions are no longer required.

In addition, the unique design and construction of the shield assembly 54 enables one to attach a rain shield to the stack 14 of the incinerator 10 which expands independently to the expansion of the stack 14, thus eliminating many problems which have heretofore been encountered when using shield assemblies with the stack of an incinerator. Further the shield assembly 54 can be easily and efficiently connected to the stack 14 with simple hand tools.

While the subject invention has been described in terms of certain preferred embodiments, and illustrated by certain drawings, such are intended for illustrative purposes and alternatives or equivalents may readily occur to those skilled in the art without departing from the spear or scope of the invention as set forth in the appended claims.

What is claimed is:

1. An improved, self-supporting incinerator having a combustion chamber for burning sulfur bearing streams therein and adapted to eliminate plume formation resulting from the combustion of such sulfur bearing streams, the incinerator comprising:

a vertically disposed housing having a lower end portion, a medial portion, and an opposed upper end portion;

a vertically disposed elongated stack having a lower end portion, a medial portion, and an upper end portion;

a combustion chamber operably communication with the lower end portion of the stack, the elongated stack and the combustion chamber being concentrically disposed in the housing such that the combustion chamber is disposed substantially adjacent the lower end portion of the housing, the upper end portion of the housing (being connected to a medial portion of the stack such that the upper end portion of the stack extends) extending a predetermined distance from the upper end portion of the housing; and a plurality of laterally disposed support members connecting the opposed upper end portion of the housing to the medial portion of the stack such that an annular space is formed between the upper end portion of the housing and the medial portion of the stack and the housing serves as an outer shield for the portion of the stack disposed therein.

2. The improved, self-supporting incinerator of claim 1 wherein the medial portion of the stack adjacent the lower end portion of the stack is flared such that the lower end portion of the stack is larger in diameter than the medial portion and the upper end portion of the stack.

3. The improved, self-supporting incinerator of claim 2 which further comprises:

a refractory liner disposed within the stack and secured thereto via an interior surface of the stack, the refractory liner extending the length of the stack.

4. An improved expandable shield for an elongated stack of an incinerator comprising:

a plurality of shield members, each of the shield members having an upper end portion and an opposed lower end portion, the shield members being disposed around the stack and forming an annular passageway therebetween such that air can enter and exit the annular passageway;

first connecting means for connecting the upper end of each of the shield members to the stack; and second connecting means for slidably connecting the lower end of each of the shield members to the stack such that in an assembled position the shield is expandable independently to the expansion of the stack.

5. An improved, self-supporting incinerator having a combustion chamber for burning sulfur bearing streams therein and adapted to eliminate plume formation resulting from the combustion of such sulfur bearing streams, the incinerator comprising:

a vertically disposed housing having a lower end portion, a medial portion, and an opposed upper end portion;

a vertically disposed elongated stack having a lower end portion, a medial portion, and an upper end portion;

a combustion chamber operably communicating with the lower end portion of the stack and integrally formed as the lower end portion of the stack, the elongated stack and the combustion chamber being concentrically disposed in the housing such that the combustion chamber is disposed substantially adjacent the lower end portion of the housing, the upper end portion of the housing being connected to the medial portion of the stack such that the upper end portion of the stack extends a predetermined distance from the upper end portion of the housing;

a plurality of shield members, each of the shield members having an upper end portion and an opposed lower end portion, the shield members being disposed around the stack such that the shield members are positioned between the upper end portion of the stack and the upper end portion of the housing, the shield members cooperating with the stack to form an an annular passageway therebetween;

first connecting means for connecting the upper end of each of the shield members to the stack; and second connecting means for slidably connecting the lower end of each of the shield members to the stack such that in an assembled position the shield members are expandable independently to the expansion of the stack.

6. An improved, self-supporting incinerator having a combustion chamber for burning sulfur bearing streams therein and adapted to eliminate plume formation resulting from the combustion of such sulfur bearing streams, the incinerator comprising:

a vertically disposed housing having a lower end portion, a medial portion, and an opposed upper end portion;

a vertically disposed elongated stack having a lower end portion, a medial portion, and an upper end portion;

a combustion chamber operably communicating with the lower end portion of the stack, the elongated stack and the combustion chamber being concentrically disposed in the housing such that the combustion chamber is disposed substantially adjacent the lower end portion of the housing, the upper end portion of the housing being connected to a medial portion of the stack such that the upper end portion of the stack extends a predetermined distance from the upper end portion of the housing;

a plurality of shield members, each of the shield members having an upper end portion and an opposed lower end portion, the shield members being disposed around the stack such that the shield members are positioned between the upper end portion of the stack and the upper end portion of the housing, the shield members cooperating with the stack to form an annular passageway therebetween;

first connecting means for connecting the upper end of each of the shield members to the stack; and second connecting means for slidably connecting the lower end of each of the shield member to the stack such that in an assembled position the shield members are expandable independently to the expansion of the stack.

7. An improved expandable shield for an elongated stack of an incinerator comprising:

a plurality of shield members, each of the shield members having an upper end portion and an opposed lower end portion, the shield members being disposed around the stack so as to form an annular passageway therebetween;

first connecting means for connecting the upper end of each of the shield members to the stack, the first connecting means comprising:

a plurality of first spacer members having a first side and an opposed second side, each of the first spacer members being axially disposed along the perimeter of the stack and connected to the stack via the first side of each of the first spacer members such that the second side of each of the first spacer members is disposed a first distance from the stack;

a first ring element positionable over each of the first spacer members and disposed adjacent the opposed second side of each of the first spacer member; and a first connecting element for interconnecting an upper end portion of the shield member to the adjacently disposed first spacer members via the ring element; and second connecting means for slidably connecting the lower end of each of the shield members to the stack such that in an assembled position the shield is expandable independently to the expansion of the stack.

8. An improved expandable shield for an elongated stack of an incinerator comprising:

a plurality of shield members, each of the shield members having an upper end portion and an opposed lower end portion, the shield members being disposed around the stack so as to form an annular passageway therebetween;

first connecting means for connecting the upper end of each of the shield members to the stack, the first connecting means comprising:

a plurality of first spacer members having a first side and an opposed second side, each of the first spacer members being axially disposed along the perimeter of the stack and connected to the stack via the first side of each of the first spacer members such that the second side of each of the first spacer members is disposed a first distance from the stack;

a first ring element positionable over each of the first spacer members and disposed adjacent the opposed second side of each of the first spacer members; and a first connecting element for interconnecting an upper end portion of the shield member to the adjacently disposed first spacer members via the ring element;

second connecting means for slidably connecting the lower end of each of the shield members to the stack such that in an assembled position the shield is expandable independently to the expansion of the stack; and support means for slidably supporting a portion of each of the shield members in a spaced apart relation with the stack, the support means being positioned substantially intermediate the upper end portion and the lower end portion of the shield members.

9. The improved, self-supporting incinerator of claim 5 further comprising:

support means for slidably supporting a portion of each of the shield members in a spaced apart relation with the stack, the support means being positioned substantially intermediate the upper end portion and the lower end portion of the shield members.

10. The improved, self-supporting incinerator of claim 5 or 6 wherein the first connecting means comprises:

a plurality of first spacer members having a first side and an opposed second side, each of the first spacer members being axially disposed along the perimeter of the stack and connected to the stack via the first side such that the second side of each of the first spacer members is disposed a first distance from the stack;

a plurality of first ring elements, each first ring element positionable over a first spacer member and disposed adjacent the opposed second side of the first spacer member; and a plurality of first connecting elements for interconnecting an upper end portion of each shield member to an adjacently disposed first spacer member via a first ring element.

11. The improved, self-supporting incinerator of claim 10 wherein the second connecting means comprises:

a plurality of second spacer members, each second spacer member axially disposed along the perimeter of the stack a selected distance from a first spacer member, each of the second spacer members having a first side, an opposed second side, an upper side, and an opposed lower side, each of the second spacer members being connected to the stack via the first side of the second spacer member such that the second side is disposed a second distance from the stack;

a plurality of flanges, each flange supportably connected to a second spacer member along the upper side of the second spacer member such that the flange extends a distance from the opposed second side of the second spacer member and defines an upper edge portion of a recessed slot on the opposed second side of each second spacer member;

a plurality of second ring elements, each second ring element possitionable over a second spacer member and disposed adjacent the opposed second side of the second spacer member, each second ring element defining a lower edge portion of the recessed slot formed on the opposed second side of each second spacer member;

a plurality of second connecting elements for interconnecting the upper end portion of each second shield member to the adjacently disposed second spacer member via a second ring element;

a plurality of third ring elements, each third ring element positionable in the recessed slot of a second spacer member and movable therein between a flange and a second ring element; and a plurality of third connecting elements for interconnecting a lower edge portion of each first shield member to a third ring element.

12. The improved, self-supporting incinerator of claim 11 wherein the opposed lower end portion of each first shield member is positioned in an overlapping relationship with the upper end portion of a second shield member.

13. The improved, self-supporting incinerator of claim 12 wherein the arrangement and connection of the first and second shield members to the stack is repeated substantially along the portion of the stack between the upper end portion of the stack between the upper end portion thereof and the upper end portion of the housing, and wherein at least a portion of the first and second shield members are connected to the stack such that the opposed lower end portion of selected first shield members is disposed a distance from the upper end portion of the adjacent second shield members and forms an air space therebetween.

14. The improved, self-supporting incinerator of claim 13 further comprising:

air deflector means for deflecting air exiting the passageway between one of the second shield members and the stack, and for directing air into the passageway between an upper, adjacent first shield member and the stack, the air deflector means being secured to the stack within the air space formed between the opposed lower end portion of the first shield members and the upper end portion of the adjacent second shield members.

15. The improved, self-supporting incinerator of claim 11 further comprising:

a plurality of third spacer members axially disposed along the perimeter of the stack at a position between the first and second spacer members, each of the third spacer members having a first side, an opposed second side, an upper side, an an opposed lower side, each of the third spacer members being connected to the stack via the first side thereof such that the opposed second side of each third spacer member is disposed a distance from the stack;

a plurality of first flanges, each first flange supportably connected to a third spacer member along the upper side of the third spacer member, each first flange extending a distance from the opposed second side of the third spacer member and defining an upper edge portion of a recessed slot on the opposed second side of each third spacer member;

a plurality of second flanges, each second flange connected to a third spacer member along the opposed lower side of the third spacer member, each second flange extending a distance from the opposed second side of the third spacer member and defining a lower edge portion of the recessed slot on the opposed second side of the third spacer member;

a plurality of fourth ring elements, each fourth ring element slidably positioned within the recessed slot of a third spacer member; and a plurality of fourth connecting elements for interconnecting each first shield member to a fourth ring element.

16. The improved expandable shield of claim 7 or 8 wherein the second connecting means comprises:

a plurality of second spacer members axially disposed along the perimeter of the stack a selected distance from the first spacer members, each of the second spacer members having a first side, an opposed second side, an upper side, and an opposed lower side, each of the second spacer members being connected to the stack via the first side of the second spacer member such that the second side is disposed a second distance from the stack;

a plurality of flanges, each flange supportably connected to each of the second spacer members along the upper side of the second spacer member such that the flange extends a distance from the opposed second side of the second spacer member and defines an upper edge portion of a recessed slot on the opposed second side of each second spacer member;

a plurality of second ring elements, each second ring element positionable over each of the second spacer members and disposed adjacent the opposed second side of each of the second spacer members, each second ring element defining a lower edge portion of the recessed slot formed on the opposed second side of each second spacer member;

a plurality of second connecting elements for interconnecting the upper end portion of each second shield member to the adjacently disposed second spacer member via a second ring element;

a plurality of third ring elements, each third ring element positionable in the recessed slot of a second spacer member and movable therein between a flange and a second ring element; and a plurality of third connecting elements for interconnecting the lower edge portion of each first shield member to a third ring element.

17. The improved expandable shield of claim 16 wherein the opposed lower end portion of each first shield member is positioned in an overlapping relationship with the upper end portion of the adjacent second shield member.

18. The improved expandable shield of claim 17 wherein the arrangement and connection of the first and second shield members to the stack is repeated along at least a portion of the stack, and wherein at least a portion of the first and second shield members are connected to the stack such that the opposed lower end portion of selected first shield members are disposed a distance from the upper end portion of the adjacent second shield members to form an air space therebetween.

19. The improved expandable shield of claim 18 further comprising:

air deflector means for deflecting air exiting the passageway between one of the second shield members and the stack, and for directing air into the passageway between an upper, adjacent first shield member and the stack, the air deflector means being secured to the stack within the air space formed between the opposed lower end portion of the first shield member and the upper end portion of the adjacent second shield member.

20. The improved, expandable shield of claim 16 which further comprises:

a plurality of third spacer members axially disposed along the perimeter of the stack at a position between the first and second spacer members, each of the third spacer members having a first side, an opposed second side, an upper side, and an opposed lower side, each of the third spacer members being connected to the stack via the first side of the third spacer member such that the opposed second side of the third spacer member is disposed a distance from the stack;

a plurality of first flanges, each first flange supportably connected to a third spacer member along the upper side of the third spacer member such that the flange extends a distance from the opposed second side of the third spacer member and defines an upper edge portion of a recessed slot on the opposed second side of each third spacer member;

a plurality of second flanges, each second flange connected to a third spacer member along the opposed lower side of the third spacer member such that the flange extends a distance from the opposed second side of the third spacer member and defines a lower edge portion of the recessed slot on the opposed second side of the third spacer member;

a plurality of fourth ring elements, each fourth ring element slidably positioned within the recessed slot of a third spacer member; and a plurality of fourth connecting elements for interconnecting each first shield member to a fourth ring element.

* * * * *